US005462274A

United States Patent [19]

Takatsuka

[11] Patent Number: 5,462,274

[45] **Date of Patent: * Oct. 31, 1995**

[54] TENNIS RACKET WITH LONGITUDINAL STRINGS DIFFERENT IN TENSILE FORCE FROM TRANSVERSAL STRINGS

[75] Inventor: Masanori Takatsuka, Shizuoka, Japan

[73] Assignee: Yamaha Corporation, Japan

[ * ] Notice: The portion of the term of this patent subsequent to May 10, 2011, has been disclaimed.

[21] Appl. No.: 207,948

[22] Filed: Mar. 8, 1994

[30] Foreign Application Priority Data

Mar. 9, 1993 [JP] Japan ..... 5-072893
Oct. 29, 1993 [JP] Japan ..... 5-294526

[51] Int. Cl.[6] ..... A63B 49/02
[52] U.S. Cl. ..... 273/23 C
[58] Field of Search ..... 273/73 R, 73 C, 273/73 D, 73 E, 73 G

[56] References Cited

U.S. PATENT DOCUMENTS 3,999,756 12/1976 Head .
4,437,662 3/1984 Soong .
4,725,059 2/1988 Du Gardin et al. ..... 273/73 C X
4,736,949 4/1988 Muroi .
4,768,786 9/1988 Kuebler .
5,211,691 5/1993 Sol .
5,310,179 5/1994 Takatsuka ..... 273/73 C

FOREIGN PATENT DOCUMENTS 93210 11/1983 European Pat. Off. .
317711 5/1989 European Pat. Off. .
2682881 4/1993 France .
3327009 2/1985 Germany .

*Primary Examiner*—Raleigh W. Chiu
*Attorney, Agent, or Firm*—Ostrolenk, Faber, Gerb & Soffen

[57] ABSTRACT

A tennis racket has longitudinal strings stretched in a longitudinal direction between a frame top and a grid end and transversal strings stretched in a transversal direction perpendicular to the longitudinal direction, and a ratio of a tensile force exerted on each longitudinal string to a tensile force exerted on each transversal string ranges from 2.5:1 to 4.0:1 so that a nodal line for vibrations in the secondary mode passes through a sweet area, thereby decreasing a reaction from the tennis racket at an impact against a tennis ball.

11 Claims, 9 Drawing Sheets

Fig·12a
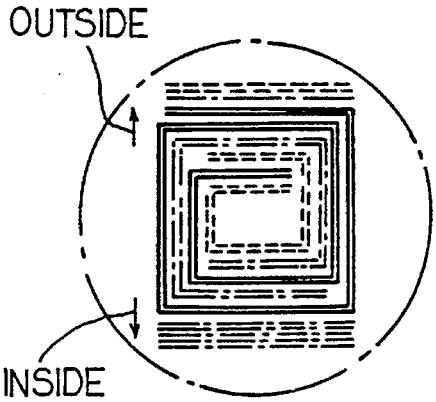
Fig·12b
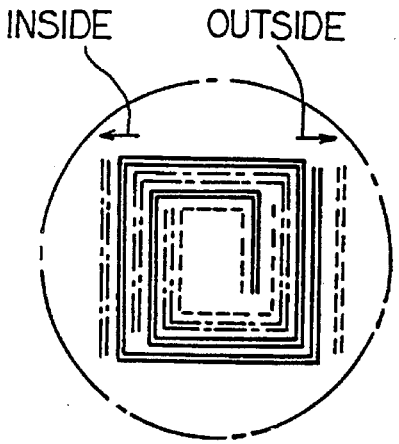
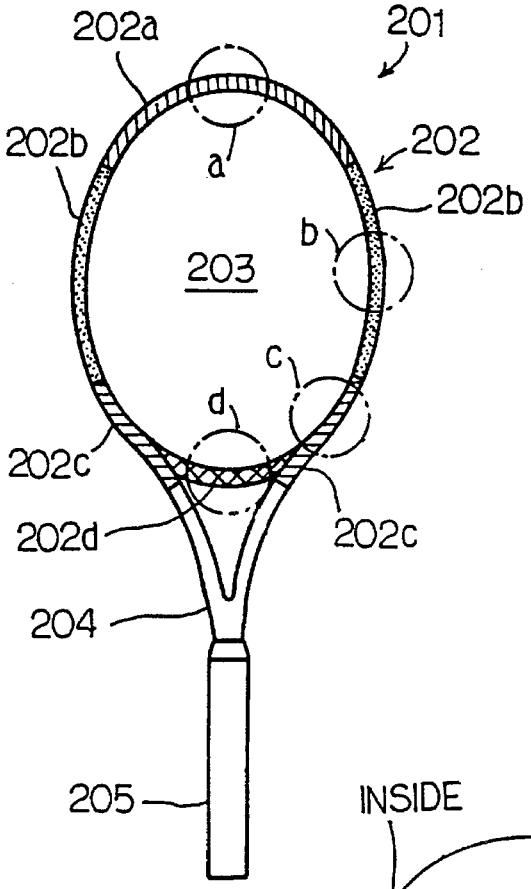
Fig·12
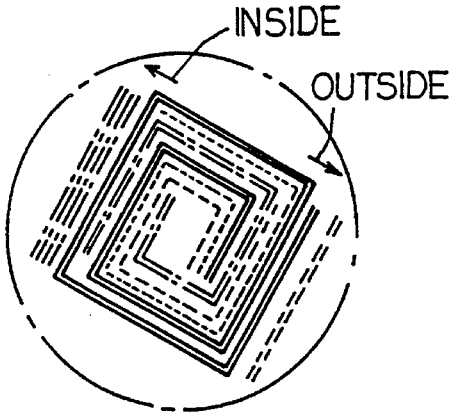
Fig·12c
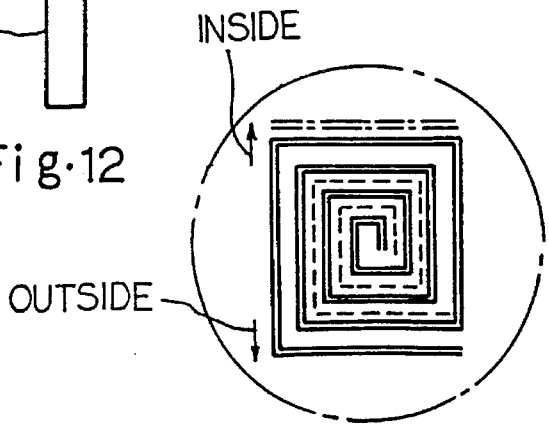
Fig·12d

TENNIS RACKET WITH LONGITUDINAL STRINGS DIFFERENT IN TENSILE FORCE FROM TRANSVERSAL STRINGS

FIELD OF THE INVENTION

This invention relates to a tennis racket and, more particularly, to a tennis racket having longitudinal strings strongly stretched rather than transversal strings.

DESCRIPTION OF THE RELATED ART

A typical example of the tennis racket is disclosed in U.S. Pat. No. 3,999,756, and the prior art tennis racket achieves a wide sweet spot. However, the inventor states that the these desirable features are attained without resort of weights, strings or the complications but instead are attained by increasing the size of the head primarily in the direction of the mid-point of the racket. Therefore, the prior art tennis racket disclosed in the U.S. Patent exerts the tensile force equally on the longitudinal strings and the transversal strings.

Another prior art tennis racket is disclosed in U.S. Pat. No. 4,768,786, and the prior art tennis racket, and the prior art tennis racket matches the vibrations produced thereon with the vibrations of a tennis ball at the impact for a strong rebounded ball. However, the U.S. Patent is silent to the tensile force exerted on the vertical strings and to the transversal strings. Since the tensile force on the vertical strings and the tensile force on the transversal strings are usually regulated in a ratio of 1:1, the prior art tennis racket disclosed in the U.S. patent is considered to equally exert the same tensile force on both longitudinal and transversal strings.

Thus, the prior art tennis rackets stretch the vertical strings and the transversal strings under the same tensile force.

One of the problems inherent in the prior art tennis rackets is encountered in long use in that players are liable to have damages in the elbows due to the reaction at the impact against the tennis ball. The damages are called as "tennis elbow". When a player hits a tennis ball at the sweet spot or the sweet area, the player feels a week shock, and the prior art tennis racket disclosed in U.S. Pat. No. 3,999,756 can decrease the shock at the impact. However, even if a player continues to exactly hit a tennis ball at the sweet area, the player suffers from the tennis elbow in a long period of time.

The manufacturers have taken two approaches against the damages. One the approaches is to add a damping weight member to the tennis racket, and the damping weight member aims at rapid attenuation of the vibrations produced in the racket frame upon impact of the tennis ball. The damping weight member is fairly effective against the vibrations. However, the damping weight member can not decrease the reaction at the impact of the tennis ball, and large force is still exerted to the elbow. Moreover, the player feels the tennis racket with the damping weight member heavy, and the damping weight member is not attractive to the tennis players.

The second approach is to wrap the grip in a cushion sheet. The cushion sheet is expected to take up the impact and the vibrations. However, the cushion sheet decreases the impact against the tennis ball, and does not allow the player to make a strong stroke.

SUMMARY OF THE INVENTION

It is therefore an important object of the present invention to provide a tennis racket which prevents player's elbow from damages without playing characteristics.

To accomplish the object, the present invention proposes to place a nodal line of secondary mode vibrations in the vicinity of a nodal line of primary mode vibrations.

In accordance with the present invention, there is provided a tennis racket comprising: a) a racket frame having a shaft portion for allowing a player to grip on a grip end thereof and a head portion providing a strung surface and merged into the head portion, the strung surface having a top end opposite to the grip end; b) longitudinal strings stretched over the head portion in a longitudinal direction parallel to virtual line between the top end and the grip end; and c) transversal strings stretched over the head portion in a transversal direction substantially perpendicular to the longitudinal direction for forming the strung surface together with the longitudinal strings, a ratio of a first tensile force exerted on each longitudinal string to a second tensile force exerted on each transversal string ranging from 2.5:1 to 4.0:1.

BRIEF DESCRIPTION OF THE DRAWINGS

The features and advantages of the tennis racket according to the present invention will be more clearly understood from the following description taken in conjunction with the accompanying drawings in which:

FIG. 12 is a front view showing another tennis racket according to the present invention.

DESCRIPTION OF THE PREFERRED EMBODIMENTS

Analysis of Vibrations in Tennis Racket at Impact

The present inventor analyzed the microscopical behavior of a tennis racket at an impact with a tennis ball for developing a tennis racket effective against the tennis elbow.

In detail, the present inventor prepared a tennis racket with the longitudinal strings G1 and the transversal strings G2 equally stretched (see FIG. 1), and set the tennis racket to an automatic hitting machine for measuring the vibrations at a grip. When the tennis ball rebounded on the strung surface of the tennis racket, a bending moment was exerted on the tennis racket, and the tennis racket vibrated. The impact point was stepwise changed from the frame top TP of the tennis racket toward a grip GP along a center line CL in the longitudinal direction of the racket, and the present inventor measured the amplitude at the grip GP for the vibrations in the primary mode and the amplitude at the grip GP for the vibrations in the secondary mode.

Figure 1A:
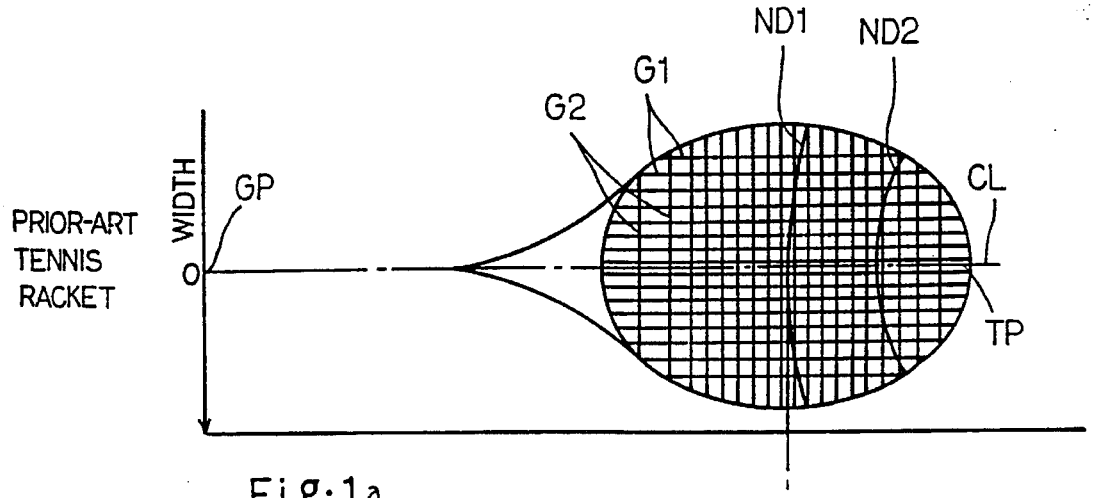
Fig·1a PRIOR ART
FIG. 1 is a graph showing the amplitudes of vibrations in the primary and secondary modes in terms of an impact point on a prior art tennis racket.
Figure 1B:
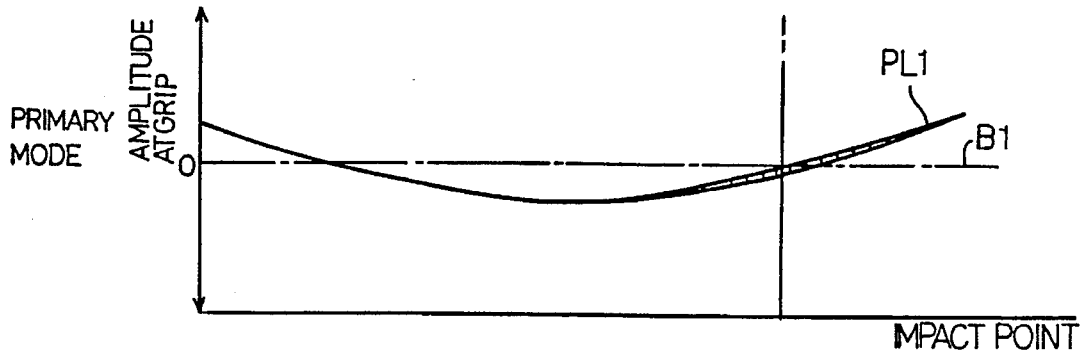
Fig·1b PRIOR ART
Figure 1C:
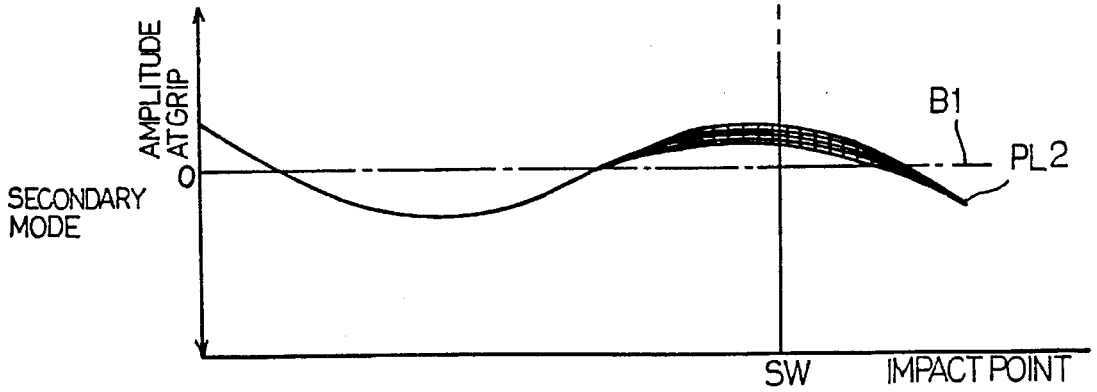
Fig·1c PRIOR ART

FIG. 1 further shows the amplitudes at the grip GP of the vibrations in the primary and secondary modes. ND1 and ND2 stand for a nodal line of the vibrations in the primary mode and a nodal line of the vibrations in the secondary mode, respectively, and a sweet spot SW takes place at the crossing point between the nodal line ND1 and the center line CL. A sweet area is a small area in the neighborhood of the sweet spot SW where a player does not feel a substantial reaction from a tennis racket at an impact against a standard tennis ball as similar to the sweet spot SW. The sweet area is usually defined by manufacturers as "an area having a coefficient of restitution equal to or larger than a predetermined value". The predetermined value usually ranges from 60 per cent to 80 per cent.

A tennis player feels the magnitude of the reaction from the tennis racket at an impact against a tennis ball in proportional to the absolute value of the maximum amplitude at the grip GP. For this reason, the gap between a neutral line B1 and plots PL1 and PL2 is indicative of the magnitude of the reaction felt by a player.

The amplitude of the primary mode vibrations was plotted in a different scale from the amplitude of the secondary mode vibrations, and the maximum amplitude of the secondary mode vibrations was about 12 per cent of the maximum amplitude of the primary mode vibrations. Though not shown in FIG. 1, the maximum amplitude of the tertiary vibrations was of the order of 4 per cent of the maximum amplitude of the primary mode vibrations. This tendency was observed in higher-order modes, and the tertiary mode vibrations and the higher-order mode vibrations were ignorable in view of the tennis elbow.

When the tennis ball rebounds on the sweet spot SW, the amplitude of the primary mode vibrations is minimized. However, the sweet spot SW maximizes the amplitude of the secondary mode vibrations. This is the reason why senior tennis player also suffer from the tennis elbow.

The present inventor noticed that a tensile force in the longitudinal direction unbalanced with a tensile force in the in the transversal direction changed the nodal line ND2 of the secondary mode vibrations, and concluded that the unbalanced tensile forces matched the nodal line ND2 with the nodal line ND1 of the primary mode vibrations.

Figure 2:
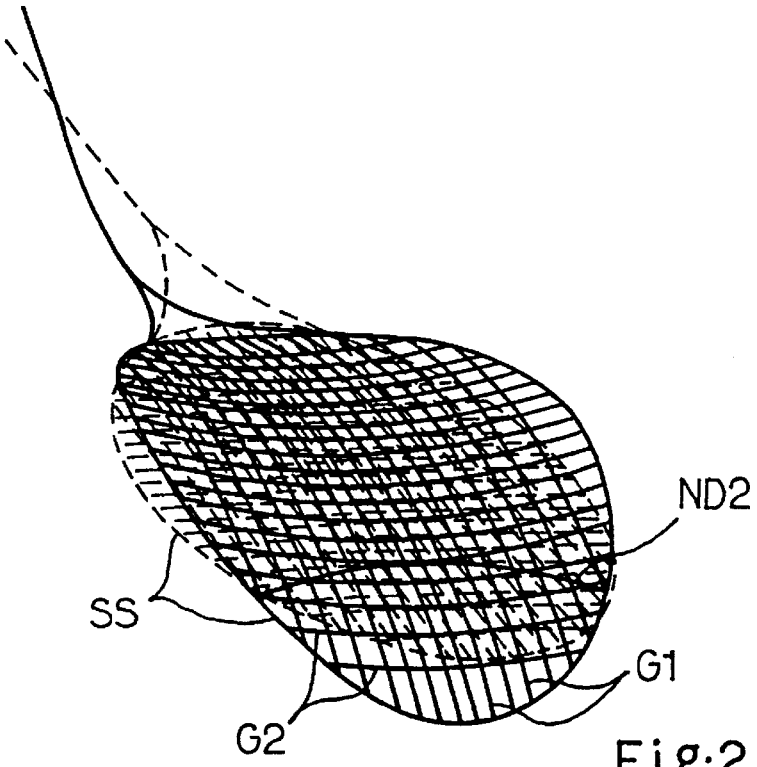
Fig·2 PRIOR ART
FIG. 2 is a perspective view showing the secondary mode vibrations produced in the prior art tennis racket.

In detail, FIG. 2 illustrates the prior art tennis racket, and standard longitudinal strings G1 and standard transversal strings G2 were equally stretched at 50 pounds. The nodal line ND2 was gently warped on the strung surface SS of the tennis racket. However, if a tensile ratio of the tensile force on the longitudinal direction to the tensile force on the transversal direction was changed from 1:1 (or 50 pounds/50 pounds) through 5:3 (or 60 pounds/40 pounds) to 2:1 (70 pounds/35 pounds), the nodal line of the secondary mode vibrations were sharply warped as indicated by ND21, ND22 and ND23 (see FIG. 3), and the return point was getting closer to the sweet spot SW as indicated by RT21, RT22 and RT23.

Figure 4:
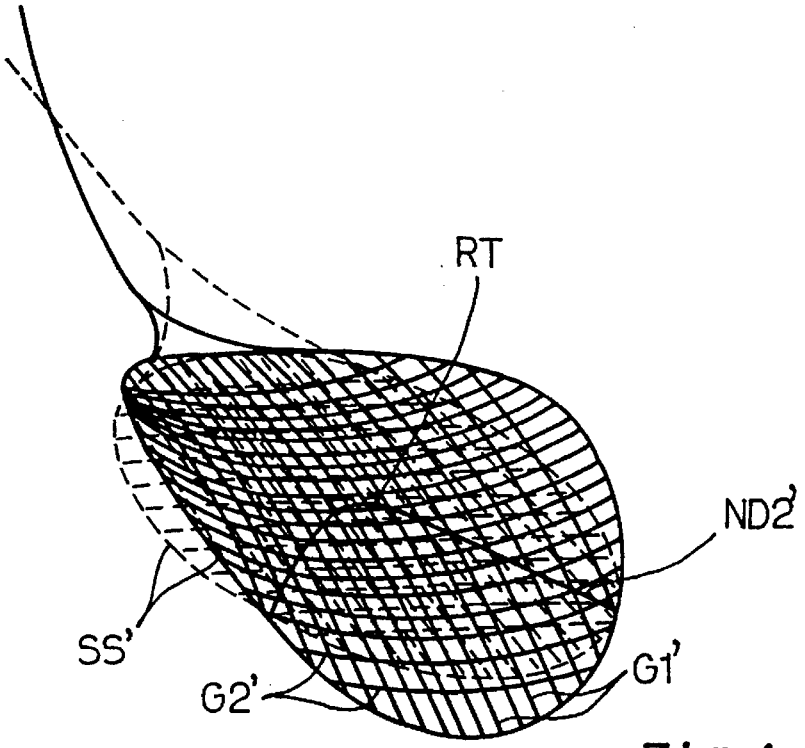
FIG. 4 is a perspective view showing secondary mode vibrations produced in a tennis racket according to the present invention.
Figure 3A:
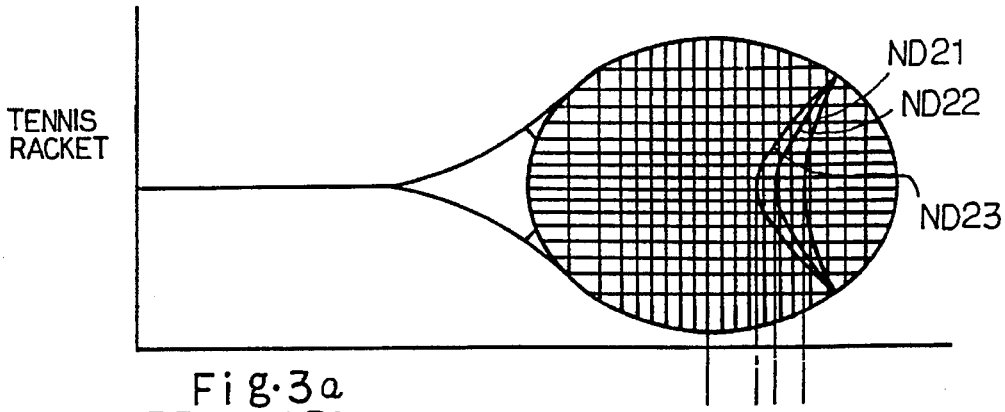
Fig.3a PRIOR ART
FIG. 3 is a graph showing the amplitudes of secondary mode vibrations in terms of an impact point on another prior art tennis racket.
Figure 3B:
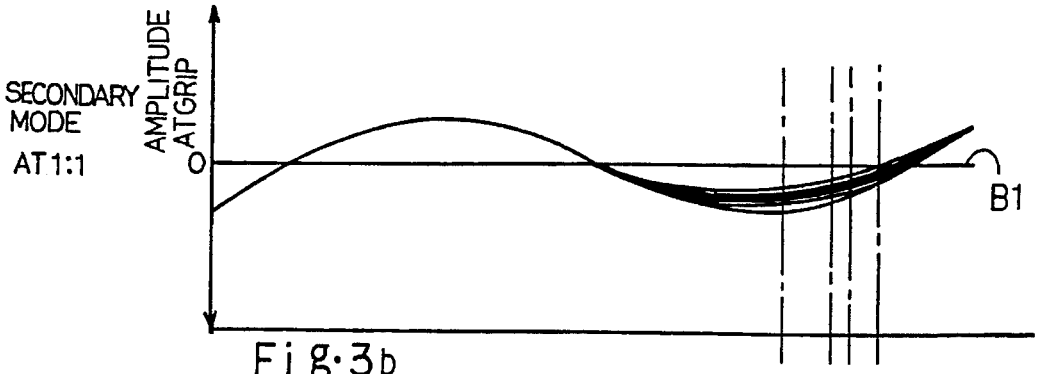
Fig.3b PRIOR ART
Figure 3C:
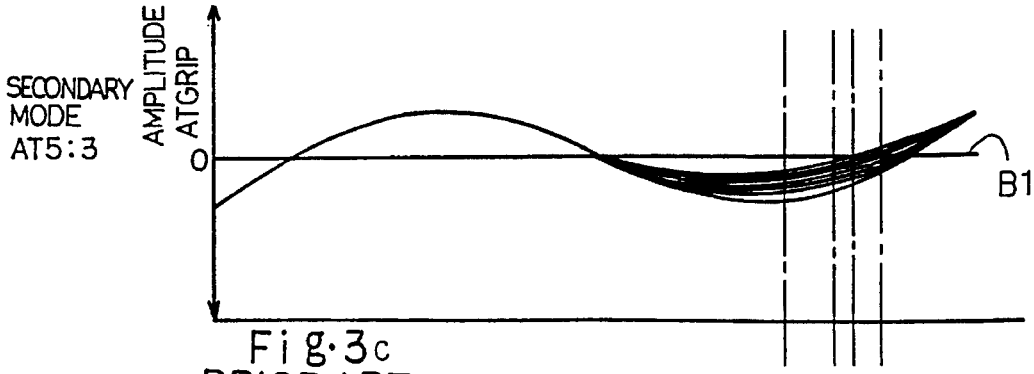
Fig.3c PRIOR ART
Figure 3D:
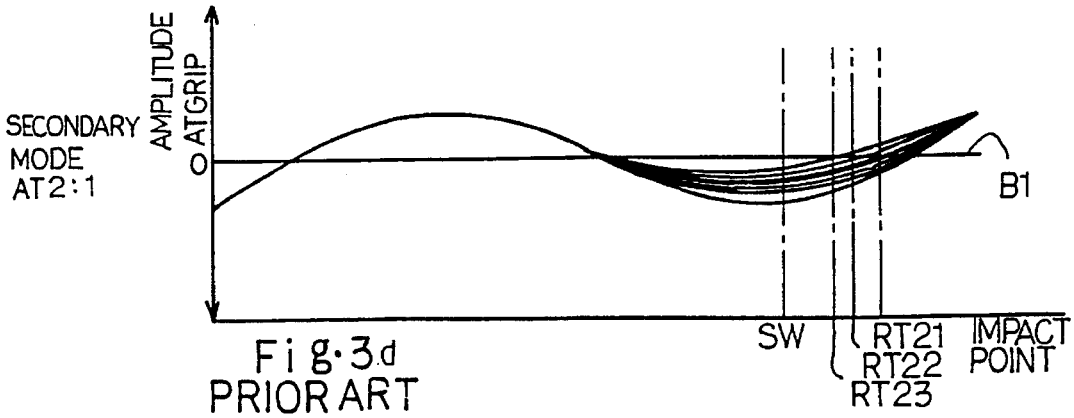
Fig.3d PRIOR ART

When standard longitudinal strings G1' and standard transversal strings G2' were unequally stretched at 80 pounds and at 27 pounds or at the tensile ratio of 3:1, the strung surface SS' was widely vibrated as shown in FIG. 4, and the vibrations in the secondary mode had a nodal line ND2' sharply warped on the strung surface SS'. The return point RT of the nodal line ND2' became closer to the nodal line of the primary mode vibrations, and reached a sweet area on the strung surface SS'.

Figure 5A:
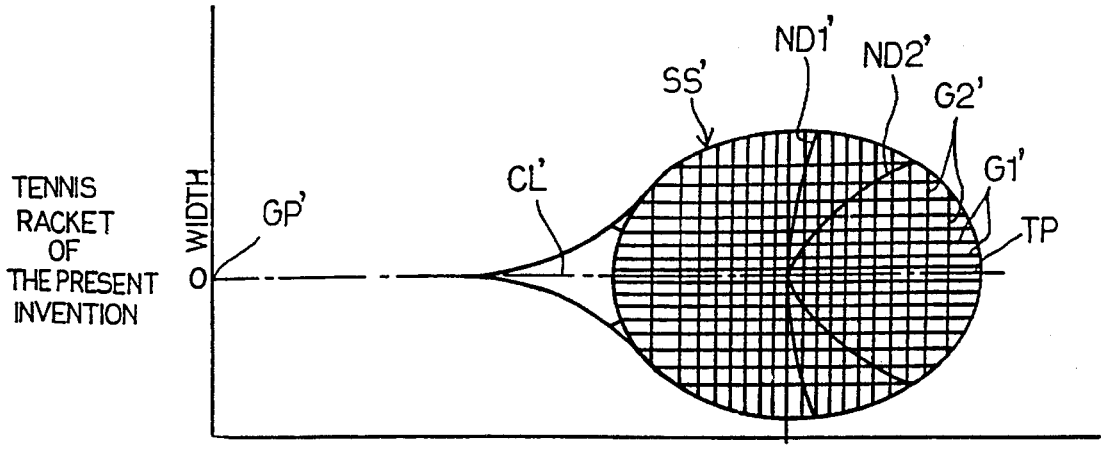
FIG. 5 is a graph showing the amplitudes of vibrations in the primary and secondary modes in terms of an impact point on a tennis racket according to the present invention.
Figure 5B:
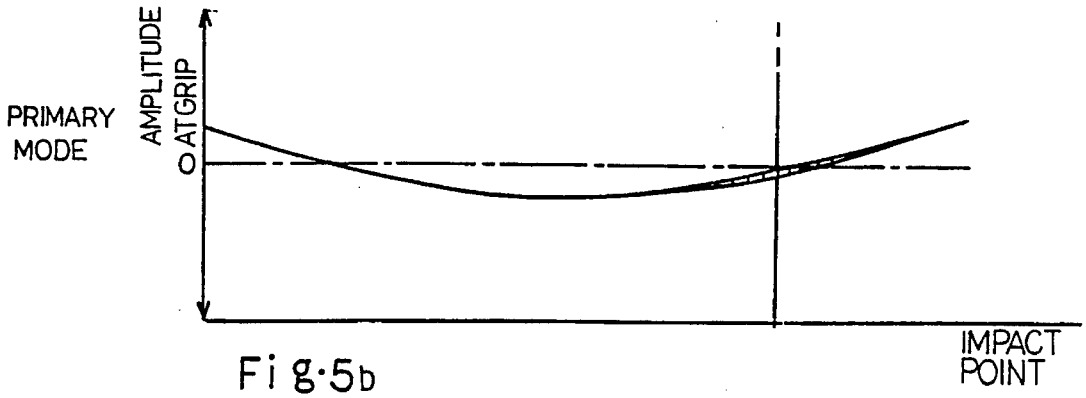
Figure 5C:
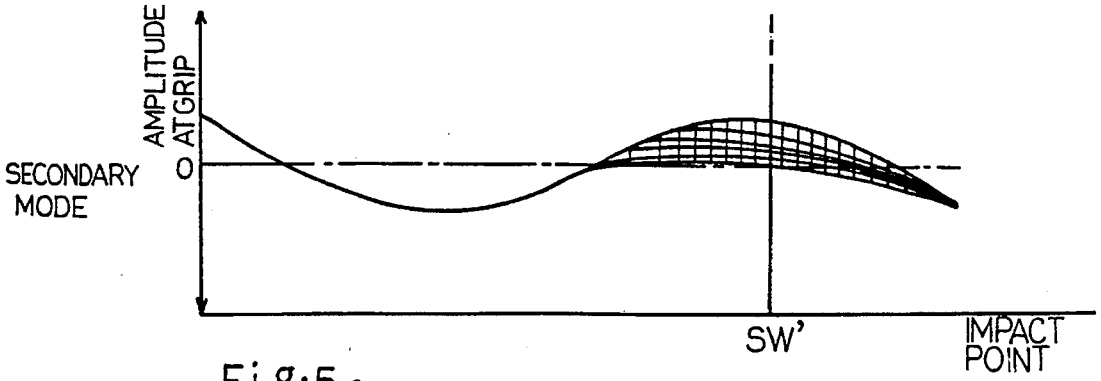

The tennis racket shown in FIG. 4 was further set to the automatic hitting machine, and the amplitudes of vibrations in the primary and secondary modes were measured at the grip GP' by changing the impact point against a tennis ball along the center line CL' in the longitudinal direction. The tennis racket according to the present invention vibrated like a saddle. Since a nodal line of the primary mode vibration was indicated by Plots ND1' gently warped, the sharply warped nodal line ND2' was merged into the nodal line ND1' at the sweet spot SW' on the strung surface SS' as shown in FIG. 5. In other words, when the tennis ball rebounded at the sweet spot SW', the amplitude at the grip GP was minimized in both primary and secondary mode vibrations.

Figure 6:
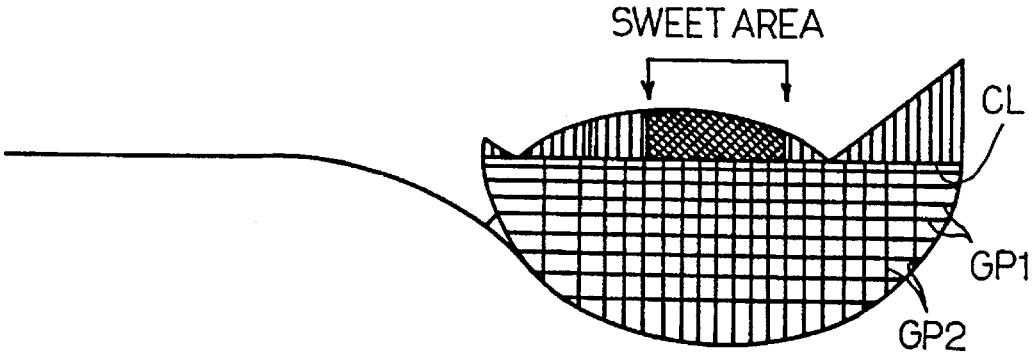
Fig.6 PRIOR ART
FIG. 6 is a graph showing the impact at the grip of the prior art tennis racket due to the secondary mode vibrations in terms of the impact point.
Figure 7:
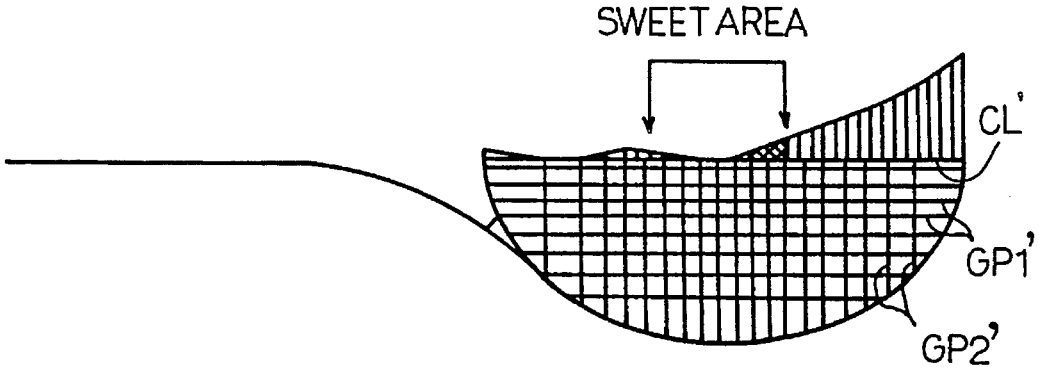
FIG. 7 is a graph showing the impact at the grip of the tennis racket according to the present invention due to the secondary mode vibrations in terms of the impact point.

Although the reaction at the grip GP due to the secondary mode vibrations was approximately equal to the reaction at the grip GP' in so far as the tennis ball rebounded on the frame tops TP, the reaction at the grip GP' due to the tennis ball rebounding on the sweet area was drastically decreased in comparison with the total reaction at the grip GP of the prior art tennis racket as shown in FIGS. 6 and 7.

The present inventor confirmed that the nodal line ND2' reached the sweet area if the ratio of the tensile force on the longitudinal strings G1' to the tensile force on the transversal strings G2' ranged from 2.5:1 to 4.0:1 regardless of the value of the tensile force.

Analysis of Frame Available for the Tennis Racket

If the tensile force is too small, the tennis racket does not make a standard tennis ball swift. For this reason, the strung surface SS' is expected to have high coefficient of restitution. In a practical usage, a center zone of the strung surface SS' ranges from 25 N/mm to 40 N/mm in spring constant or from 40 to 65 in the RA Test. However, a standard tennis player usually expects the center zone to have the spring constant equal to or greater than 30 N/mm which is corresponding to the RA Test equal to or greater than 50.

A standard large-sized tennis racket has a racket frame defining a face area of 710 $cm^2$ (110 $inch^2$). Using the standard large-sized tennis racket, standard longitudinal strings G1' and standard transversal strings G27 are stretched over the racket frame at the tensile ratio of 3:1 for forming a strung surface. In order to regulate the spring constant equal to or greater than 30 N/mm at the center zone of the strung surface, a string stretcher needs to exert a tensile force equal to or greater than 77 pounds and a tensile force equal to or greater than 26 pounds on the longitudinal strings and the transversal strings, respectively.

A prior art standard racket frame has been regulated to 80 to 200 N/mm in rigidity against a compressive force in the longitudinal direction thereof. Even an special racket frame does not exceed 240 N/mm.

Figure 8:
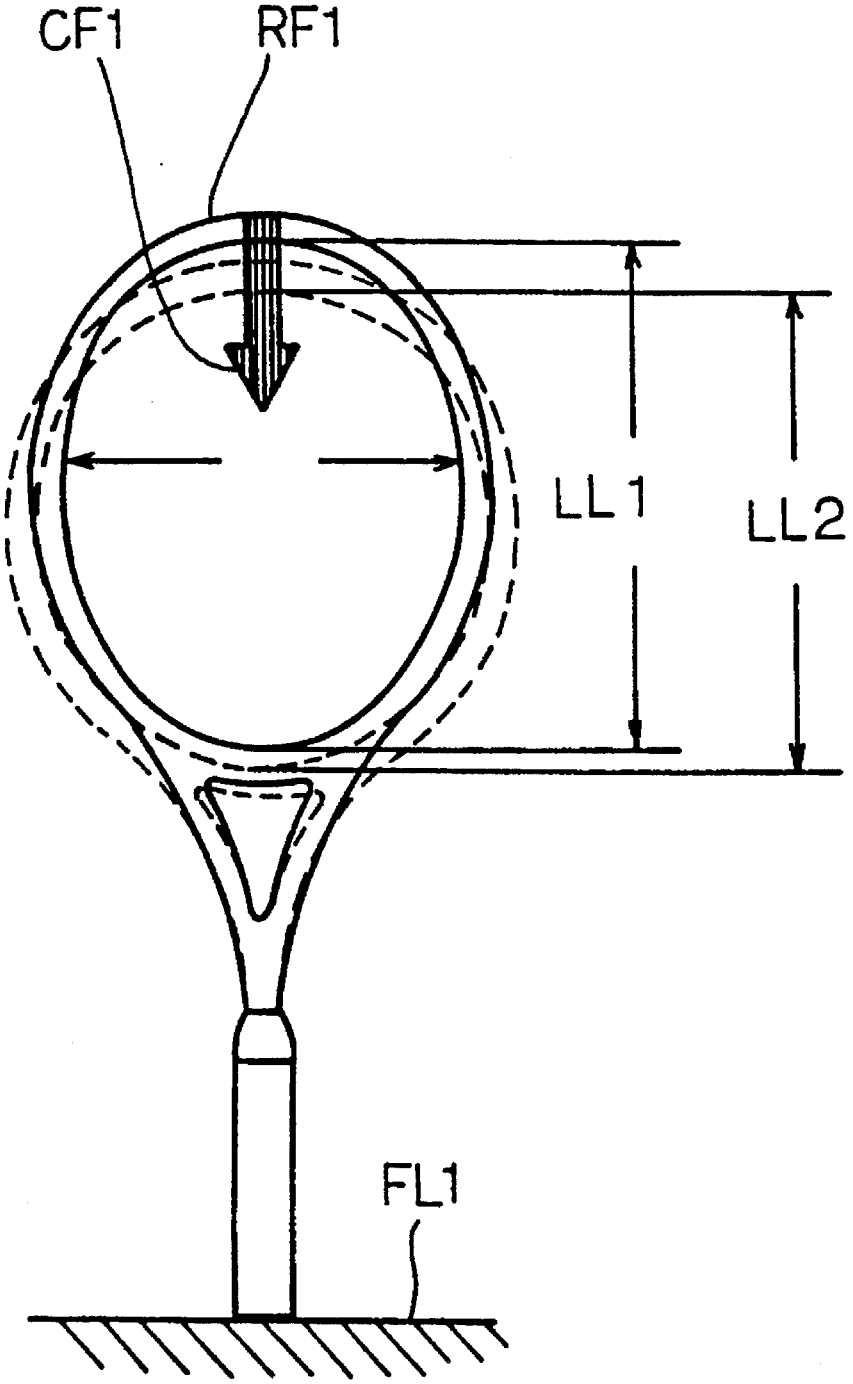
Fig·8 PRIOR ART
FIG. 8 is a front view showing a measurement of a rigidity of a racket frame against a compressive force.

The rigidity against the compressive force is defined as a ratio of a decrement under a compressive force to the compressive force. In detail, if a compressive force W is exerted on a racket frame RF1 standing on a rigid frame FL1 as shown in FIG. 8, the racket frame RF1 is deformed, and the longitudinal length is decreased from LL1 to LL2. The rigidity RG of the racket frame RF1 is calculated as

RG=(LL1−LL2)/W

Figure 9:
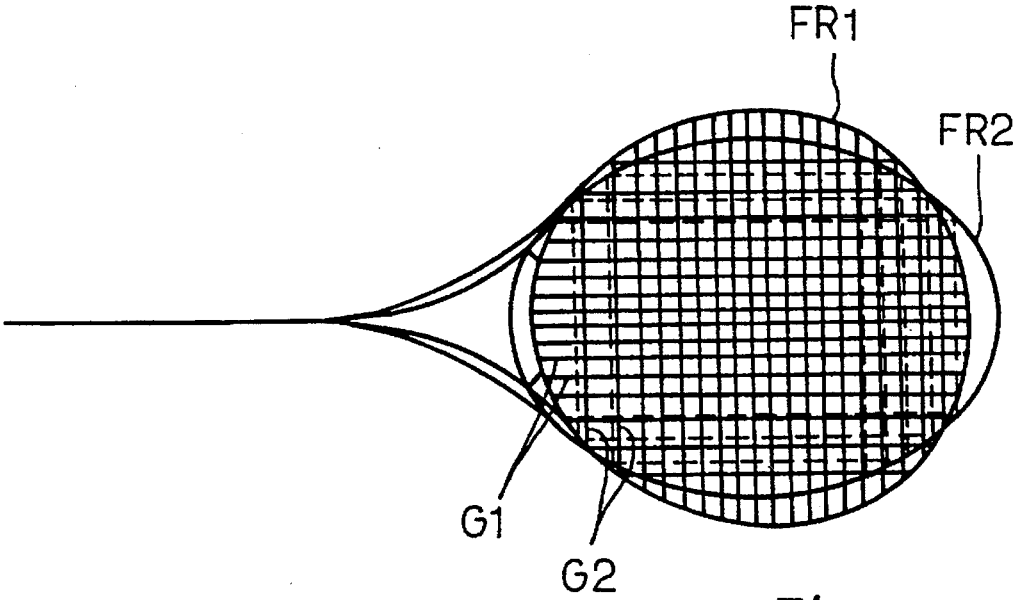
Fig. 9 PRIOR ART
FIG. 9 is a front view showing a deformation of the prior art tennis racket due to the longitudinal and transversal strings.

If the standard longitudinal strings G1 and the standard transversal strings G2 are stretched over the prior art racket frame at 77 pounds and at 26 pounds, the prior art racket frame can not withstand the large compression force, and is immediately deformed as indicated by the real line FR1 in FIG. 9. Real line FR2 is indicative of the racket frame supporting the standard longitudinal strings and the standard transversal strings stretched at standard tensile forces. As a result, the longitudinal strings G1 is loosened, and the transversal strings G2 is tightened. This means that the tensile ratio becomes outof the desirable range between 2.5:1 and 4.0 to 1.

Of course, if the tensile forces are, by way of example, regulated to 100 pounds and 5 pounds, the tensile forces after the deformation may fall within the range between 2.5:1 and 4.0:1. However, such a widely deformed racket frame is unstable in dynamics, and is deteriorated in playing characteristics. This means that a player can not control a return and feels the tennis racket irregular. In case of the standard racket frame, such an extremely large tensile force crushes the racket frame.

The present analysis proceeds to a rigidity of a racket frame according to the present invention. A standard string stretcher can exert the maximum tensile force of 90 pounds to a vertical string, and a racket frame is allowed to only decrease the tensile force at 13 pounds so as to keep the tensile force at, for example, 77 pounds upon taken out from the standard string stretcher. A standard nylon string is elongated at 1 per cent per 10 pounds, and the vertical string is elongated at 9 per cent under the tensile force of 90 pounds. When the racket frame is taken out from the standard string stretcher, the longitudinal strings are allowed to be elongated at 7.7 per cent, and the racket frame is allowed to decrease the tensile force exerted on the longitudinal string at 9.0–7.7=1.3 per cent. In other words, the racket frame can be elastically deformable against the compressive force in the longitudinal direction at only 1.3 per cent.

In order to keep the racket frame within the contraction of 1.3 per cent, it is necessary for the racket frame to have the rigidity against the compression in the longitudinal direction at 330 N/mm or more. The racket frame is further required to have the rigidity against the compression in the transversal direction at 100 N/mm for the transversal string stretched under the tensile force of 26 pounds. In general, when both longitudinal and transversal strings are stretched over the racket frame, the compressive force due to the longitudinal strings partially cancels the compressive force due to the transversal strings. For this reason, present invention requires the racket frame to have the rigidity against the compressive force in the transversal direction equal to or greater than 60 N/mm.

Figure 10:
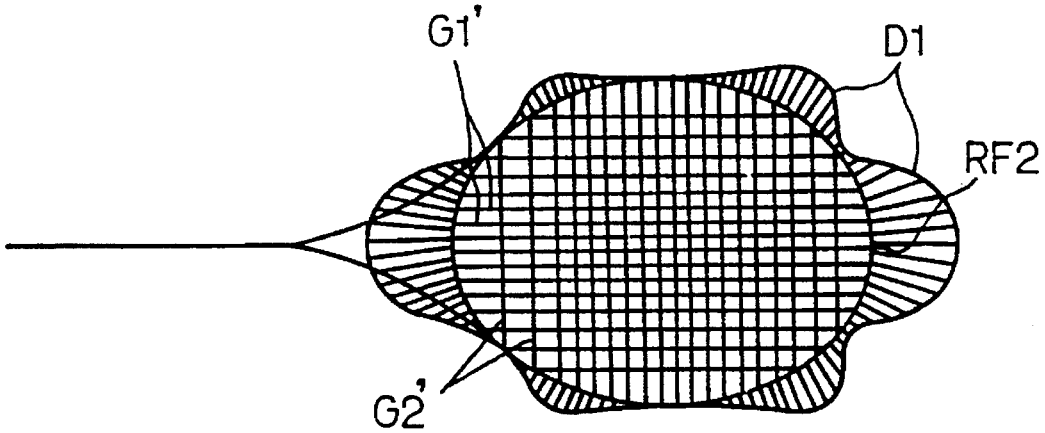
FIG. 10 is a front view showing a strain distribution along the periphery of a racket frame having longitudinal strings and transversal strings stretched at the tensile ratio of 3:1.

If the longitudinal strings G1 and the transversal strings G2 were stretched over a racket frame RF2 with an uniform rigidity under the tensile forces exerted on the longitudinal and transversal strings at 3:1 in accordance with the present invention, the strain D1 was dispersed along the periphery of the racket frame as shown in FIG. 10. In order to appropriately give a rigidity against the compressive forces to a racket frame under the minimum increase of the weight, it is necessary to reinforce the parts of the racket frame where the large strain take place.

The present inventor concludes that a partially reinforced racket frame withstands the longitudinal strings stretched under the tensile ratio falling within the above discussed range. In other words, one of the approaches for supporting the strings under the above described tensile ratio is to partially reinforce a racket frame in accordance with the strain distribution shown in FIG. 9.

If, for example, the racket frame according to the present invention achieves the rigidity of 330 N/mm against the compressive force in the longitudinal direction and the rigidity of 60 N/mm against the compressive force in the transversal direction, the standard string stretcher can appropriately stretches the vertical strings and the transversal strings without substantial deformation, and the tensile force at 81 pounds and the tensile force at 27 pounds are left on each longitudinal string and each transversal string, respectively. The tensile ratio is about 3:1, and falls within the above described range. This results in that the nodal line of the secondary mode vibrations passes through the sweet area, and the tennis player is effectively prevented from the tennis elbow. The rigidities may be greater than 330 N/mm and 60 N/mm.

FIRST EMBODIMENT

Figure 11:
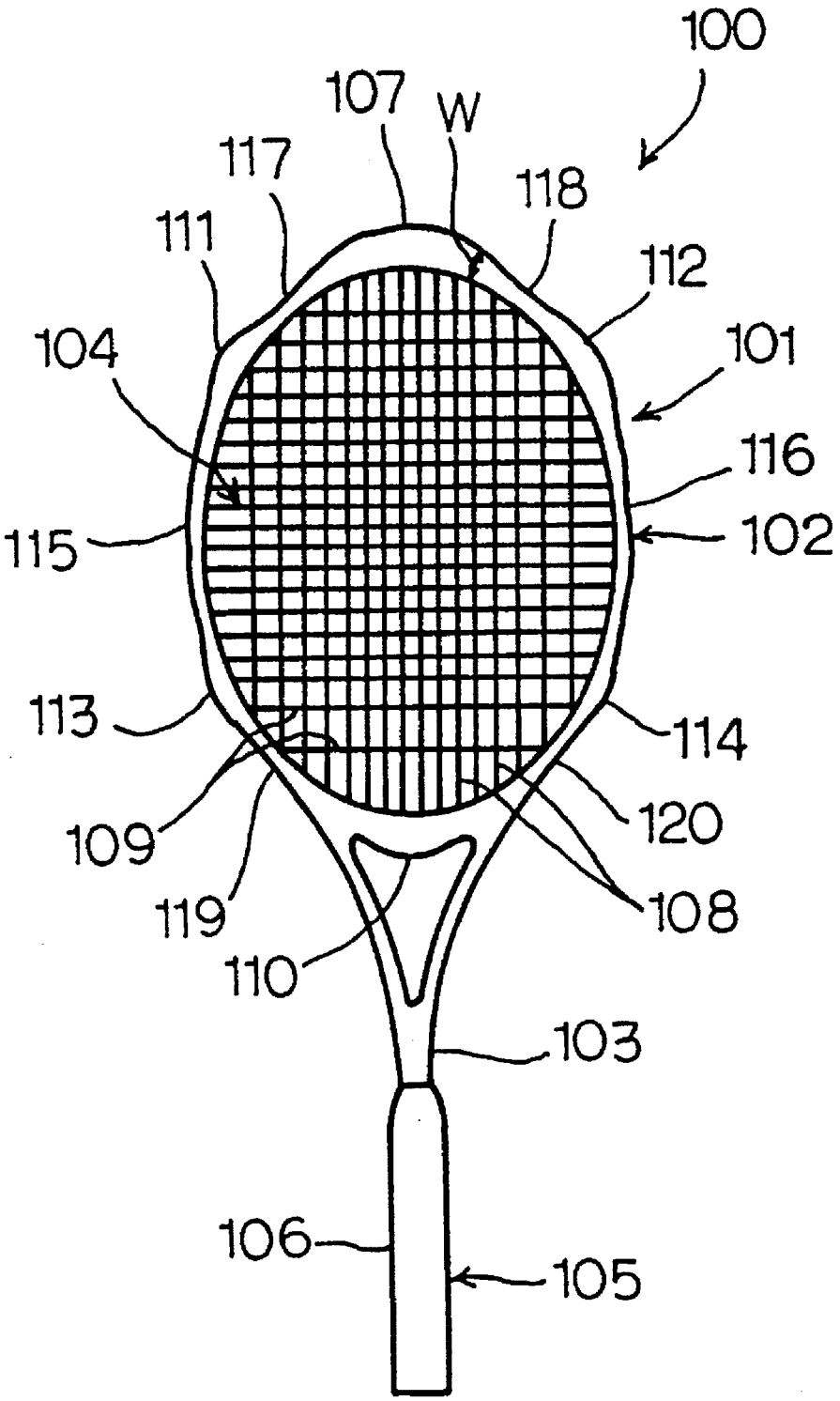
FIG. 11 is a front view showing a tennis racket according to the present invention.

Turning to FIG. 11 of the drawings, a tennis racket 100 embodying the present invention comprises a racket frame 101 having a head portion 102 and a shaft portion 103 merged into the head portion 102. The racket frame 101 is formed of a composite material of carbon-fibers and glass-fibers. The head portion 102 provides a strung surface 104, and the head portion 102 is enclosed with a grip member 105 for providing a grip end portion 106. The head portion 102 has a width w varied in proportional to the strain. A longitudinal direction of the tennis racket 100 extends between a frame top 107 and the grip end portion 106, and a transversal direction extends perpendicularly to the longitudinal direction.

The tennis racket embodying the present invention further comprises longitudinal strings 108 and transversal strings 109, and the longitudinal strings 108 and the transversal strings 109 are of the standard nylon type. The longitudinal strings 108 are stretched over the head portion 102 in parallel to one another in the longitudinal direction, and the transversal strings 109 are further stretched over the head portion 102 in parallel to one another in the transversal direction. The longitudinal strings 108 and the transversal strings 109 form in combination the strung surface 104.

In this instance, the width w is determined on the assumption that the tensile ratio is 3:1, and the racket frame 101 has the rigidity of 350 N/mm against the compressive force in the longitudinal direction and the rigidity of 110 N/mm against the compressive force in the transversal direction. In order to achieve the rigidities, the racket frame 101 has the widest portions at the frame top 107 and at a yoke portion 110 opposite to the frame top, average portions 111 to 114 between the frame top 107 and the yoke portion 110 and the narrowest portions 115 to 120 between the thickest portions and the average portions and between the average portions, because the largest strain, an average strain and the smallest strain take place at the widest portions 107/110, at the average portions 111 to 114 and at the narrowest portions 115 to 120, respectively.

In case of the racket frame 101 where the rigidity against the compressive force in the longitudinal direction is not less than 330 N/mm and the rigidity against the compressive force in the transversal direction ranges between 60 N/mm and 100 N/mm, the racket frame 101 is never crushed under the tensile force of 81 pounds on each longitudinal string 108 and the tensile force of 27 pounds on each transversal string 109 which fall in the tensile ratio at 3:1. However, if the longitudinal strings 108 and the transversal strings 109 are stretched over the racket frame 101 for long time period, the large compressive forces may have undesirable influence on the tennis racket 101. For this reason, it is recommendable to release the longitudinal strings 108 and the transversal strings 109 from the racket frame 101.

The present inventor produced the racket frame 101, and the widest portions 107/110, the average portions 111 to 114 and the narrowest portions 115 to 120 were adjusted to 20 millimeter in width, 18 millimeters in width and 14 millimeters in width. The racket frame 101 measured 350 N/mm in the rigidity against the compressive force in the longitudinal direction and 110 N/mm in the rigidity against the compressive force in the transversal direction. The vertical strings 108 and the transversal strings 109 were stretched under the tensile force of 80 pounds and the tensile force of 27 pounds, respectively, and the remaining tensile force on each longitudinal string 108 and the remaining tensile force on each transversal string 109 fell in the tensile ratio of 3:1 upon release from a standard string stretcher. Only a negligible amount of deformation took place in the head portion 102.

The present inventor confirmed good playing characteristics. Namely, the strung surface 104 was stable, and the tennis racket 100 achieved good playing characteristics such as, for example, a controlling characteristic on a tennis ball. The reaction at the grip was drastically decreased upon strike at the sweet area.

The present inventor further produced another racket frame 101, and the widest portions 107/110, the average portions 111 to 114 and the narrowest portions 115 to 120 were adjusted to 20 millimeter in width, 17 millimeters in width and 11 millimeters in width. The racket frame 101 measured 330 N/mm in the rigidity against the compressive force in the longitudinal direction and 65 N/mm in the rigidity against the compressive force in the transversal direction. The vertical strings 108 and the transversal strings 109 were stretched under the tensile force of 80 pounds and the tensile force of 27 pounds, respectively, and the remaining tensile force on each longitudinal string 108 and the remaining tensile force on each transversal string 109 fell in the tensile ratio of 3:1 upon release from the standard string stretcher. A negligible amount of deformation merely took place in the head portion 102.

The present inventor confirmed good playing characteristics. Namely, the strung surface 104 was stable, and the tennis racket 100 achieved good playing characteristics such as, for example, a controlling characteristic on a tennis ball. The reaction at the grip was drastically decreased upon a strike at the sweet area.

SECOND EMBODIMENT

Turning to FIG. 12 of the drawings, another tennis racket embodying the present invention also comprises a racket frame 201 having a head portion 202 for a strung surface 203 and a shaft portion 204 enclosed with a grip member 205. Though not shown in FIG. 12, vertical strings and transversal strings are stretched over the head portion 202, and the tensile force in the longitudinal; direction and the tensile force in the transversal direction fall within a ratio between 2.5:1 and 4.0:1.

The head portion 202 is substantially uniform in width, and is fabricated from frame pieces 202*a*, 202*b*, 202*c* and 202*d* different in structure and, accordingly, in rigidity. Reinforced members of, for example, CFRP (Carbon Fiber Reinforced Plastic) are appropriately distributed to the frame pieces 202*a* to 202*d*, and the composite structures of the frame pieces 202*a* to 202*d* are encircled in dot-and-dash lines.

In the composite structures, dot-and-dashed lines are indicative of a zero-degree-oriented member, and the zero-degree-oriented member is formed of UD (Uni-Directional Composite) such as, for example, carbon-fiber-reinforced-resin where the carbon fibers in epoxy resin are oriented in parallel to the circumference of the head portion 202. The zero-degree-oriented members are effective against a stress concentration.

Broken lines are indicative of a ninety-degree-oriented members also formed of the carbon-fiber-reinforced-resin, and the carbon fibers are oriented in parallel to the direction of thickness or a normal direction with the paper where FIG. 12 is illustrated.

Doubled real lines are indicative of a bias member of the carbon-fiber-reinforced-resin, and the bias member consists of two layers where the carbon fibers are oriented to ±x degrees with respect to the circumference of the racket frame 202. In this instance, x is adjusted to 40 degrees.

Dot lines are indicative of either zero-degree-oriented or bias member.

The frame pieces 202*a* to 202*d* are arranged in such a manner that the rigidity of the head portion 202 are varied in proportional to a strain produced therein due to the longitudinal strings and the transversal strings. According to the present invention, the rigidity against the compressive force in the longitudinal direction is also equal to or greater than 330 N/mm, and the rigidity against the compressive force in the transversal direction is equal to or greater than 60 N/mm.

The racket frame thus arranged achieved the rigidity of 350 N/mm against the compressive force in the longitudinal; direction and the rigidity of 120 N/mm against the compressive force in the transversal direction, and the tennis racket adjusted to the tensile ratio at 3:1 effectively decreased the reaction at the grip at the impact against a standard tennis ball. The playing characteristics of the tennis racket were also good.

Although particular embodiments of the present invention have been shown and described, it will be obvious to those skilled in the art that various changes and modifications may be made without departing from the spirit and scope of the present invention. For example, if a racket frame is formed of an extremely rigid substance, the racket frame may support the longitudinal strings and the transversal strings stretched at the tensile ratio falling into the ratio between 2.5:1 to 4.0:1 without partial reinforcement. A tennis frame fabricated from the frame pieces may be varied in width.

What is claimed is:

1. A tennis racket comprising:

a) a racket frame having a shaft portion for allowing a player to grip on a grip end thereof and a head portion providing a strung surface and merged into said head portion, said strung surface having a top end opposite to said grip end;

b) longitudinal strings stretched over said head portion in a longitudinal direction parallel to virtual line between said top end and said grip end; and c) transversal strings stretched over said head portion in a transversal direction substantially perpendicular to said longitudinal direction for forming said strung surface together with said longitudinal strings, a ratio of a first tensile force exerted on each longitudinal string to a second tensile force exerted on each transversal string ranging from 2.5:1 to 4.0:1.

2. The tennis racket as set forth in claim 1, in which said head portion has a width varied in proportional to a strain produced therein due to said longitudinal strings and said vertical strings.

3. The tennis racket as set forth in claim 2, in which said racket frame has a rigidity equal to or greater than 330 N/mm against a compressive force in said longitudinal direction.

4. The tennis racket as set forth in claim 2, in which said racket frame has a first rigidity equal to or greater than 330 N/mm against a compressive force in said longitudinal direction and a second rigidity equal to or greater than 60 N/mm against a compressive force in said transversal direction.

5. The tennis racket as set forth in claim 1, in which said head portion is substantially uniform in width and formed from frame pieces different in rigidity, said frame pieces being arranged in such a manner that the rigidity of said head portion is varied in proportional to a strain produced therein due to said longitudinal; strings and said transversal strings.

6. The tennis racket as set forth in claim 5, in which said racket frame has a rigidity equal to or greater than 330 N/mm against a compressive force in said longitudinal direction.

7. The tennis racket as set forth in claim 5, in which said racket frame has a first rigidity equal to or greater than 330 N/mm against a compressive force in said longitudinal direction and a second rigidity equal to or greater than 60 N/mm against a compressive force in said transversal direction.

8. A racket frame for a tennis racket comprising:

a) a head portion allowing a strung surface to be stretched thereover and having a frame top; and b) a shaft portion merged into said head portion on the opposite side of said frame top and having a center axis thereof, said frame top and said center axis defining a longitudinal direction of said racket frame, said racket frame having a first rigidity equal to or greater than 330 N/mm against a compressive force in said longitudinal direction.

9. The racket frame as set forth in claim 8, in which said racket frame further has a second rigidity equal to or greater than 60 N/mm against a compressive force in a transversal direction perpendicular to said longitudinal direction.

10. The racket frame as set forth in claim 8, in which a width of said head portion is varied in proportion to a strain produced therein due to said strung surface.

11. The racket frame as set forth in claim 8, in which a width of said head portion is substantially uniform in width and formed from frame pieces different in rigidity, said frame pieces being arranged in such a manner that the rigidity of said head portion is varied in proportional to a strain produced therein due to said strung surface.

* * * * *